US006233752B1

(12) United States Patent
von Ballmoos

(10) Patent No.: US 6,233,752 B1
(45) **Date of Patent: *May 22, 2001**

(54) CISTERN BODY FOR A FLUSHING CISTERN

(75) Inventor: Mario von Ballmoos, Jona (CH)

(73) Assignee: Geberit Technik AG, Jona (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,460

(22) Filed: Nov. 18, 1998

(30) Foreign Application Priority Data

Nov. 18, 1997 (CH) ..... 2660/97

(51) Int. Cl.[7] ..... E03D 1/00
(52) U.S. Cl. ..... 4/353; 4/651
(58) Field of Search ..... 4/353, 416–419, 4/651

(56) References Cited

U.S. PATENT DOCUMENTS

| | | | | |
|---|---|---|---|---|
| 830,243 | * | 9/1906 | Magowan | 4/353 |
| 2,597,239 | * | 5/1952 | Goetz | 4/353 |
| 2,863,155 | * | 12/1958 | Harkness | 4/353 |
| 3,860,972 | | 1/1975 | Costello . | |
| 4,176,413 | * | 12/1979 | Whitney et al. | 4/353 X |
| 4,283,802 | * | 8/1981 | Icaran | 4/353 |
| 5,210,883 | * | 5/1993 | Weber et al. | 4/353 |

FOREIGN PATENT DOCUMENTS

| | | | | |
|---|---|---|---|---|
| 1158457 | | 11/1963 | (DE) . | |
| 2731732 | | 9/1996 | (FR) . | |
| 0913970 | * | 12/1962 | (GB) | 4/651 |
| 1264316 | | 2/1972 | (GB) . | |

* cited by examiner

*Primary Examiner*—Charles E. Phillips
(74) *Attorney, Agent, or Firm*—Collen Law Associates, P.C.; Robert M. McDermott

(57) ABSTRACT

The cistern body has an interior in which fittings are to be accommodated. At least one functional part of the inflow or outflow fitting is integrated in the wall of the cistern body. The functional part is preferably a pipe which forms an overflow channel, an inflow channel or an installation channel. The cistern body is preferably produced by blow molding.

6 Claims, 2 Drawing Sheets

CISTERN BODY FOR A FLUSHING CISTERN

FIELD OF THE INVENTION

The invention relates to a cistern body for a flushing cistern, having an interior in which fittings, in particular an inflow and outflow fitting, are to be accommodated.

BACKGROUND OF THE INVENTION

Cistern bodies of this type are known in general. They are usually produced from ceramic material or plastic. In recent years, an improved flushing method has made it possible to reduce to a considerable extent the quantity of water necessary for flushing. Accordingly, it has been possible for the cistern body to be constructed with a smaller volume. However, the smaller interior of the cistern bodies has resulted in difficulties as regards accommodating the fittings, that is to say, in particular, the inflow and outflow fitting. In the case of flush-mounted flushing cisterns in particular, this has resulted in the operation of installing the inflow and outflow fitting being complex and more laborious. In the case of these flushing cisterns, these fittings have to be introduced through an inspection opening arranged on the front or at the top. In addition, the overall depth is comparatively small in these flushing cisterns.

SUMMARY AND OBJECTS OF THE INVENTION

The object of the invention is to provide a cistern body of the type mentioned which avoids these difficulties. Nevertheless, the intention is for the cistern body to be functionally reliable and capable of being produced cost-effectively.

The object is achieved, in the case of a cistern body of the generic type, in that at least one functional part of the inflow or outflow fitting is integrated in the wall of the cistern body. In the case of the cistern body according to the invention, the wall thus forms part of an inflow or outflow fitting. This corresponding functional part is, in this case, integrated in the cistern body and, of course, then no longer has to be provided on the fitting part which is to be installed. Shifting at least one functional part to the outside into the wall of the cistern body makes it possible to produce smaller fittings, which are correspondingly easier to introduce into the cistern body. According to one development of the invention, the functional part integrated in the wall of the cistern body is an overflow channel. In the case of the outflow fitting, the customary overflow pipe can then be replaced by a narrow rod. It is possible for the external diameter of the outflow fitting to be reduced correspondingly. A narrower outflow fitting takes up less space in the interior of the cistern body and is considerably easier to install, for example through the inspection opening of a flush-mounted flushing cistern, and also to remove again, for inspection purposes. It is likewise easier to carry out adjusting work on the fittings.

According to one development of the invention, the functional part integrated in the cistern body is an inflow channel. Up until now, this channel has usually been provided on the inflow fitting as a downwardly projecting pipe. Shifting the inflow channel into the wall of the cistern body, then, makes it possible to produce a considerably smaller and more compact inflow fitting, which is correspondingly easier to install and to produce.

It has been found that, for the integration of said functional parts and for other functional parts as well, it is particularly advantageous to produce the cistern body by blow molding. These functional parts, and in particular pipes and channels, can be produced without additional process steps by blow molding. These functional parts are preferably integrally formed by pinching. For this purpose, two mold parts have interacting pinching parts which are correspondingly directed towards one another. In this case, said functional parts are provided fixedly on the cistern body and form an integrated part of the side walls and/or of the cistern base. These functional parts are preferably integrally formed on the cistern body and thus form part of the wall. It is preferred to produce the cistern body by blow molding. However, other production processes are also conceivable. Functional parts here are intended to mean parts which, up until now, were usually parts of the inflow or outflow fitting or of other fittings accommodated in the cistern interior. Fastening parts are not covered by such functional parts.

The invention makes it possible to produce cistern bodies with an even smaller volume than has been the case hitherto. While having a further expected improvement in the flushing method and thus even smaller quantities of flushing water than has been the case hitherto, the invention can avoid the problems inherent in the production and installation of the flushing-cistern fittings. The basic idea of the invention is thus seen in the fact that functional parts hitherto provided on fittings and flushing cistern fittings are shifted to the outside and integrated in the cistern body. The preferred production by blow molding makes it possible for such cistern bodies to be realized in a particularly straightforward and cost-effective manner.

The invention also relates to a flushing cistern having a cistern body and to a particularly suitable process for producing a cistern body according to the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
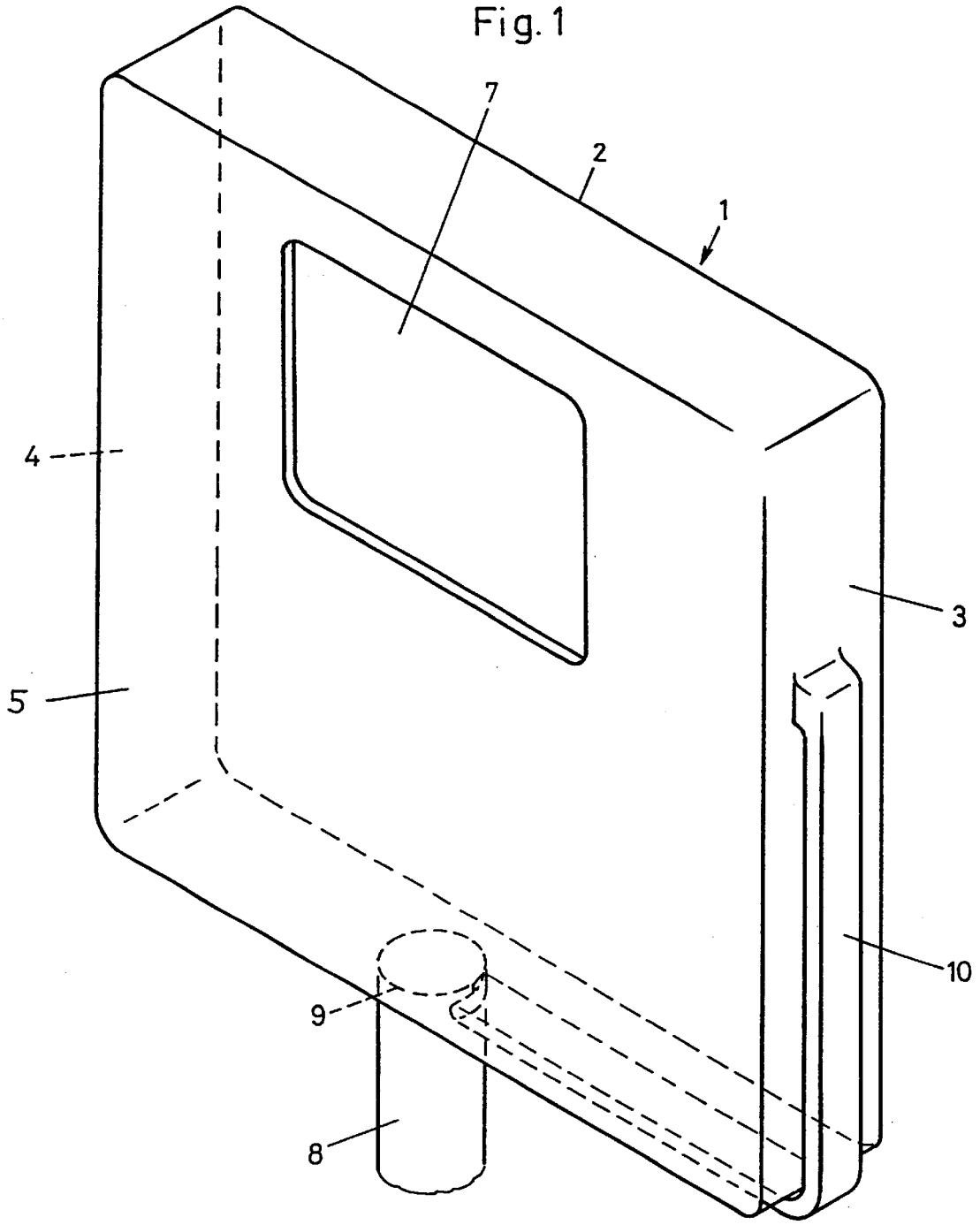
FIG. 1 shows a view of a cistern body.

FIG. 1 shows a cistern body 1 with a wall 2, which essentially forms a rectangular, comparatively narrow cistern. A so-called inspection opening 7 is provided in a front wall 5, and in particular an outflow fitting 13 (FIG. 2) and an inflow fitting 20 (FIG. 2) is introduced through this opening. It is also possible for said fittings to be inspected and removed by way of the opening 7. The cistern body 1 is intended for a flush mounted flushing cistern and is thus installed in a wall opening and covered at the front. A so-called covering panel (not shown here) is installed in front of the inspection opening 7. However, it is also possible for the inspection opening 7 to be arranged on the top side of the cistern body. A refinement in which the cistern body I is intended for a flushing cistern which is mounted visibly on a wall or on a water closet bowl is also conceivable.

Located at the base of the wall 2 is an outflow opening 9 on which an outflow pipe 8 (only shown schematically here) is provided. The outflow pipe 8 may be integrally formed on the wall 2. The outflow fitting 13 is fastened in a known manner in the interior of the cistern body 1, above the opening 9. The outflow opening 9 is closed off by a raisable valve body 14. A conventional actuating device (not shown here) can be used to raise the valve body 14, and thus to release the opening 9 for the outflow of flushing water.

Figure 5:
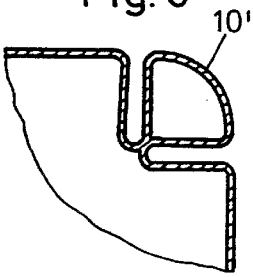
FIG. 5 shows a horizontal section through part of a flushing cistern.
Figure 6:
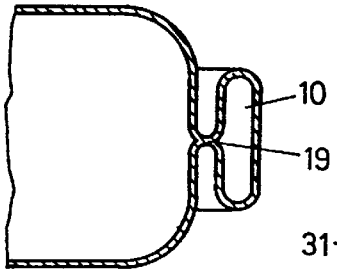
FIG. 6 shows a horizontal section through part of the flushing cistern of FIG. 1.

An overflow channel 10 is arranged, in particular integrally formed, on the outside of a side wall 3 of the wall 2. According to FIG. 2, this overflow channel 10 has a top inflow opening 11 with an overflow edge 111. The overflow channel 10 extends, externally, downwards and along the base as far as the outflow pipe 8. An orifice 12 connects the overflow channel 10 to this outflow pipe 8, as is shown clearly in FIG. 2. If, during refilling, the flushing water in the interior 40 of the cistern body 1 rises over the overflow edge 111, then the flushing-water level is prevented from rising further by overflowing into the overflow channel 10. The overflowing flushing water passes through the channel 10 into the outflow pipe 8 and, from there, into a water-closet bowl or a urinal. According to FIGS. 4 and 6, the overflow channel 10 may be arranged approximately centrally on the outside of the side wall 3. In accordance with a variant according to FIG. 5, the overflow channel 101 is located in the region of one edge of the cistern body 2. In this variant, the overflow channel. 10 protrudes to a lesser extent than in the refinement according to FIGS. 2, 4 and 6. Between the two openings 11 and 12, the overflow channel 10 is connected to the wall 2 via a comparatively narrow web 19. A refinement in which there is no such web 19 and the overflow channel 10 is fastened merely in the region of the overflow opening 11 and of the opening 12 is also conceivable. However, it is also possible for the overflow channel 10 to rest directly against, or be provided directly on, the wall 2. The cross-section of the overflow channel 10 or 10' may also be round or of some other suitable cross-section.

Since the overflow channel 10 is part of the wall 2, it is correspondingly possible for an overflow pipe to be omitted from the outflow fitting 3. In this case, the overflow pipe, which is usually integrated in the valve body 14, is replaced by a comparatively narrow rod 14'. This rod is connected at its top end to the actuating device (not shown here). It is also possible for the rod 14 to be movable or articulated or to be replaced by a chain or the like.

Figure 2:
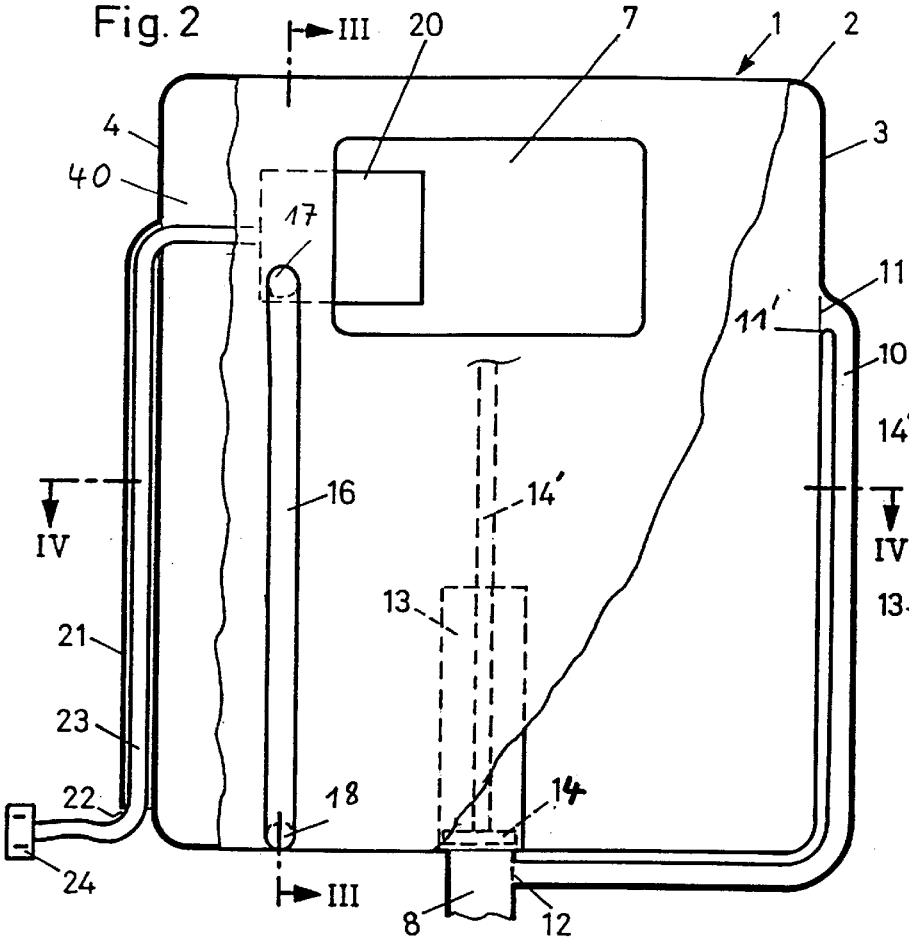
FIG. 2 shows a front view of a partially cut away cistern body with the flushing cistern fittings installed (and only illustrated schematically here)
Figure 3:
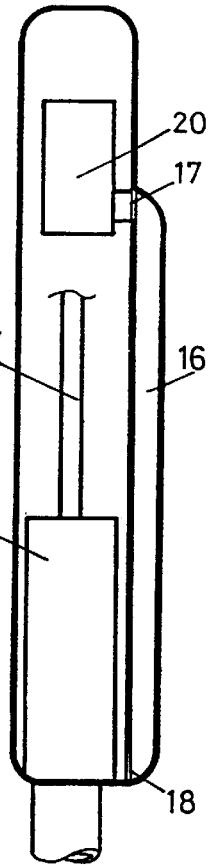
FIG. 3 shows a section along line III—III of FIG. 1.
Figure 4:
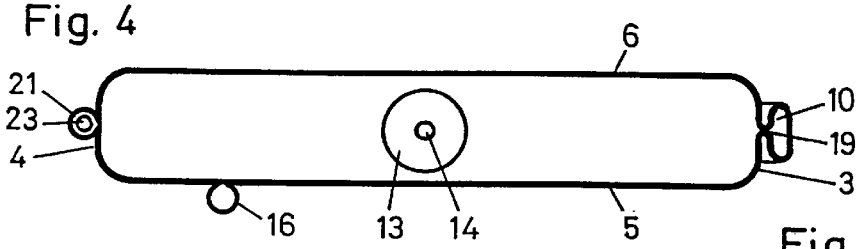
FIG. 4 shows a section along line IV—IV of FIG. 1.

According to FIG. 2, the wall 2 has an inflow channel 16 which, according to FIG. 4, is integrated in the front wall 5 on the outside. The inflow channel 16 has a top inflow opening 17 and a bottom opening 18. The top opening 17 is connected to the inflow fitting 20 via a line (not shown here). When the cistern body 1 is refilled with flushing water, this water passes from the inflow valve of the fitting 20, via said line, through the opening 17 into the channel 16 and through the bottom opening 18 into the interior of the cistern body 2. The inflow fitting 20 may also be provided directly on the opening 17, in which case the line is rendered superfluous. The otherwise conventional inflow pipe is correspondingly omitted from the inflow fitting. Otherwise, the inflow fitting 20 can be designed in the usual manner. It is connected to a supply line (not shown here) and has a conventional inflow valve (not shown here) which is regulated, for example, by a float.

According to FIGS. 2 and 4, a further channel 21 is integrally formed on a narrow side 4 of the cistern body 2. This channel has a top opening 21 which connects the channel 21 to the interior of the cistern. A bottom opening 22 leads to the outside. A flexible line 23 is introduced into the channel 21 and connects the inflow valve 20, in particular, to a W.C./douche device (not shown here). For this purpose, that end of the line 23 which projects out of the opening 22 is provided, for example, with a union nut 24. In this case, the channel 21 thus forms an installation channel for the line 23. This installation channel 24 also forms an integrated part of the wall 2.

At least one of the channels 10, 16 and 21 is realized in the case of a cistern body 1 according to the invention. Of course, it is also possible for two or all three of these channels 10, 16 and 21 to be integrated in the cistern body 2. A refinement in which, for example, the inflow channel 16 is provided on the inflow valve 20, as has been customary hitherto, is also conceivable. In the, refinement according to FIG. 1, it is only the overflow channel 10 which is integrated in the wall 2.

Figure 7:
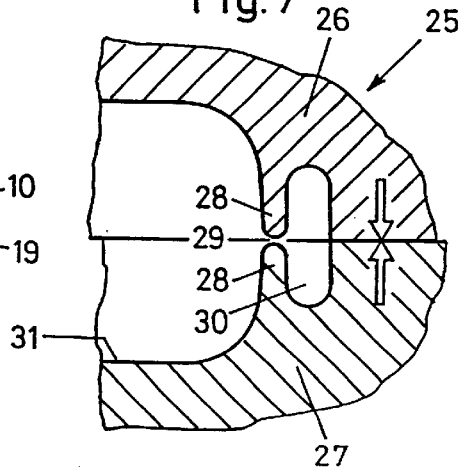
FIG. 7 shows a partial section through a blow mold for the purpose of explaining the production of a channel by pinching.

The cistern body 1 may be produced, for example, by blow molding. This is explained herein below with reference to FIG. 7. The blow molding of cistern bodies 1 is known per se. In the case of a process according to the invention, two mold halves 26 and 27 have two inwardly projecting parts 28 between which there is a comparatively narrow interspace. When the two mold parts 26 and 27 are closed, a channel-like space 30 is separated off from an inner space 31. The wall of the parison (not shown here) is pinched between the two parts 28 and forms the web 19 shown in FIG. 6. Along this web, the wall is bonded by a fusing process. The mold 24 is cooled, and the two mold parts 26 and 27 are separated, to give the cistern body I with the integrated overflow channel 10 and possibly with further integrated functional parts. No further work is required as far as the channel 10 is concerned. The cistern body 1 thus has an additional use and assumes at least one finction which has not been conventional hitherto in a cistern body.

While specific embodiments of the invention have been shown and described in detail to illustrate the application of the principles of the invention, it will be understood that the invention may be embodied otherwise without departing from such principles.

We claim:

1. Cistern body for a flushing cistern, having an interior in which a plurality of inflow and outflow fittings are to be accommodated, wherein at least one functional part of the inflow or outflow fitting is integrated in at least one wall of the cistern body;

the functional part including a pipe which forms an overflow channel, the cistern body having:

a side wall and a base wall each of which has an outside surface, an inflow opening in the side wall, and an outflow opening in the base wall, the inflow opening providing communication from the interior of the cistern body to the overflow channel, the outflow opening providing communication from the interior of the cistern body to an outflow pipe, the overflow channel extending externally downwardly on the outside surface of the side wall and along the outside surface of the base wall of the cistern body from the inflow opening to the outflow pipe, thereby providing communication from the interior of the cistern body to the outflow pipe via the overflow channel, and the overflow channel being formed via an integral web that connects the overflow channel with an exterior surface of the walls of the cistern body and isolates the overflow channel from the interior of the cistern.

2. Flushing cistern having a cistern body according to claim 1, wherein the functional parts of the inflow or outflow fitting are replaced by other functional parts which are integrated in the wall of the cistern body.

3. Flushing cistern according to claim 2, wherein the outflow fitting has a valve body with a rod-like connecting part.

4. Cistern body according to claim 1 wherein the cistern body and the web is produced by blow molding.

5. Cistern body according to claim 1, wherein said cistern body is intended for a flushing cistern of a water closet or urinal.

6. Cistern body according to claim 1 wherein the functional part is produced in one operation by blow molding.

* * * * *